United States Patent [19]

Tachick et al.

[11] 4,175,817

[45] Nov. 27, 1979

[54] ELECTRICAL CONNECTOR SWITCHING MODULE

[75] Inventors: Henry N. Tachick, Blairstown, N.J.; Reginald S. Arnold, Pittsfield, Mass.; James E. Belcher, Dalton, Mass.; Joseph A. St. Jacques, New Ashford, Mass.

[73] Assignee: General Electric Company, Philadelphia, Pa.

[21] Appl. No.: 929,135

[22] Filed: Jul. 28, 1978

Related U.S. Application Data

[63] Continuation of Ser. No. 751,692, Dec. 17, 1976, Pat. No. 4,119,358.

[51] Int. Cl.[2] ..... H01R 13/52

[52] U.S. Cl. ..... 339/111; 174/73 R; 200/144 R; 339/143 T

[58] Field of Search ..... 174/73 R; 200/144 R, 200/149 A; 339/111, 143 T, 143 R, 12 R

[56] References Cited

U.S. PATENT DOCUMENTS

| | | | |
|---|---|---|---|
| 3,920,307 | 11/1975 | Burns | 339/111 |
| 3,989,341 | 11/1976 | Ball | 339/111 |
| 4,088,383 | 5/1978 | Fischer et al. | 339/111 |

*Primary Examiner*—Roy Lake

*Assistant Examiner*—DeWalden W. Jones

*Attorney, Agent, or Firm*—William Freedman; Carl L. Silverman

[57] ABSTRACT

A connector module for loadbreak operation having an insulating housing and a switch insert. The insert includes a container with a major portion of uniform diameter and a configuration such that the diameter does not increase from its outer end to its inner end. Inside the container is a snuffer-contact assembly. A bore contact having a gas port is attached to a snuffer tube of the assembly and has fixed to it a piston adapter for driving the snuffer-contact assembly toward the open end of the container tube in response to gas generated by arcing inside the bore. Resilient sliding contact means are fixed to the piston and press against the inside wall of the container tube to establish continuous electrical contact with it even while the piston is moving. A gas check valve member is resiliently seated against the inner side of the gas port. Keyways in the piston ride over longitudinal keyribs formed in the wall of the container to prevent rotation of the piston in the container. A nosepiece is threaded into an expanded end of the container tube. Matching opposing grooves about the outer perimeter of the snuffer tube and the inner wall of the container hold an open retaining ring which resiliently restrains the snuffer-contact assembly from axial movement in the container.

9 Claims, 4 Drawing Figures

60
30
32
15
62
58
56
54
14
46
38
10
12
18
52
66
64
75
24
26
28
76
34
36
16
44
47
42
40
48
69
20
74
70
72
50

ELECTRICAL CONNECTOR SWITCHING MODULE

This is a continuation of application Ser. No. 751,692, filed Dec. 17, 1976, now U.S. Pat. No. 4,119,358.

BACKGROUND OF THE INVENTION

The present invention relates generally to separable electrical power cable connectors of the rod and bore type which are capable of loadbreak and loadmake operation and relates particularly, but not exclusively, to such connectors which have a movable piston for operating a bore contact in response to a predetermined current condition on loadmake operation.

Separable connectors are used for, among other things, interconnecting secondary electrical power circuit components, such as residential power transformers. The connectors have an insulating housing which may be provided with conductive shielding layers on the outside and inside surfaces and a conducting insert member for carrying current. The insert includes a first bore contact which will interact with a matching second rod contact of a mating second connector to complete the electrical connection.

The users of separable connectors have considered it desirable that the connectors be capable of operation while the cable is energized and feeding a load. Therefore, various features have been developed for coping with the arcing problems associated with loadmake and loadbreak operations of connectors, especially those for loadmake under fault conditions. One very significant feature which has proved to be very effective for loadmake operation under fault current conditions is the rapid movement of a bore contact to make the connection with a rod contact in response to the current through the connector. Connectors with such a feature, as well as discussions of their mode of operation are described in U.S. Patents:

U.S. Pat. No. 3,542,986 issued Nov. 24, 1970 to E. J. Kotski;

U.S. Pat. No. 3,945,699 issued May 23, 1975 to R. P. Flatt;

U.S. Pat. No. 3,930,709 issued Jan. 6, 1976 to R. J. Stanger et al.

Piston operated bore contacts are usually incorporated directly in a bushing or in a switch module. The switch module is a unit which is inserted at one end into a bushing well, and which at the other end has a receiving bore and an interface surface which can be coupled with a matching elbow module having a rod contact to be pushed into the bore and engaged by the bore contact.

The switch module can be considered to have two major components. One component is an elastomeric housing with an outer conductive elastomer shield layer and an inner conductive elastomer shield layer in an elongated receiving passageway extending into the housing. The other component is a switch insert. The insert includes a container made up of a metal container tube and insulating nosepiece. Inside the container is a snuffer-contact assembly including a piston, a bore contact, and a snuffer with ablative material in the bore. The container is electrically connected to the terminal of the bushing and the piston is electrically connected to the container tube by braided wire leads.

In operation, the gas that is generated during a loadmake with excessive current, such as when there is a fault in the circuit, passes through a gas port to a retaining chamber at the inner end and drives the piston and the attached contact and snuffer instantly toward the rod contact to complete the connection operation. This permits clearing of the fault current by a circuit breaker or fuse elsewhere in the system more capable of handling such a current and prevents a possibly violent failure of the connector.

One problem with present switching inserts has been the diameter of that portion the container which houses the piston for driving the contact. A certain minimum amount of driving surface is needed on the piston face to provide the force by pushing the contact with sufficient speed. However, the attachment of the conducting braids to the piston effectively reduces the driving surface by an amount equal to the cross-sectional area of the braids. Also, the central part of the piston must be open to accommodate a gas port for flow of the gas generated in the bore to the gas retaining chamber of the container. With these constraints, a piston with sufficient driving surface becomes so large that at least the portion of the container in which the piston is disposed is larger in diameter than is that part of the container at the nose piece, where the dimensions are limited by the necessary compatability with matching elbow modules.

The enlarged diameter of the container has some important practical consequences for manufacture of the module. In order that the insulation adhere tightly to the container for mechanical integrity, the insulation is molded around the container. The internal shield is first applied to the outer surface of the container in the form of a coating of conductive elastomeric paint. Then the container is fixed in a mold and the insulation injected at high pressures, on the order of about 4000 pounds per square inch (about 280 $Kg/cm^2$). Because the braids must be connected between the piston and the container bottom, and because that portion of the container in which the piston is situated has a larger diameter than do other portions of the container nearer the open end, the piston cannot later be inserted from the open end. Hence, it is necessary that the piston be included in the container prior to the molding step.

One problem with the prior structure as described above is that the brazing of the braids to the piston and container bottom requires additional labor and can lead to a defective insert.

Another problem with this prior structure is that with the piston and braids inside the container in the molding step, it is not feasible to install a mandrel or core pin into the container during the molding to prevent deformation of the container wall from the high pressures. It is therefore necessary to make the container wall thick enough to withstand the pressures unassisted. This added wall thickness results in excess material costs for material which is not otherwise needed for the functioning of the device itself.

A third problem with the prior structure is that if the module should, after the molding step, prove to be defective as to the insulation only, then the container, braids, and piston must be scrapped along with the insulation, for they have become inseparable parts of the assembly. Since most of the defects in the molded assemblies are in the insulation, rather than in the container or the piston, the scrapping of good containers and pistons along with the insulation is a very significant factor in the cost of the end product.

In order to avoid the above problems, as well as to provide other manufacturing and operational benefits, there is provided in accordance with the present invention a novel module having a switch insert structure permitting a reduction in the diameter of the switch insert while maintaining the desired operational capabilities of the piston therein.

DESCRIPTION OF THE PREFERRED EMBODIMENT

Figure 1:
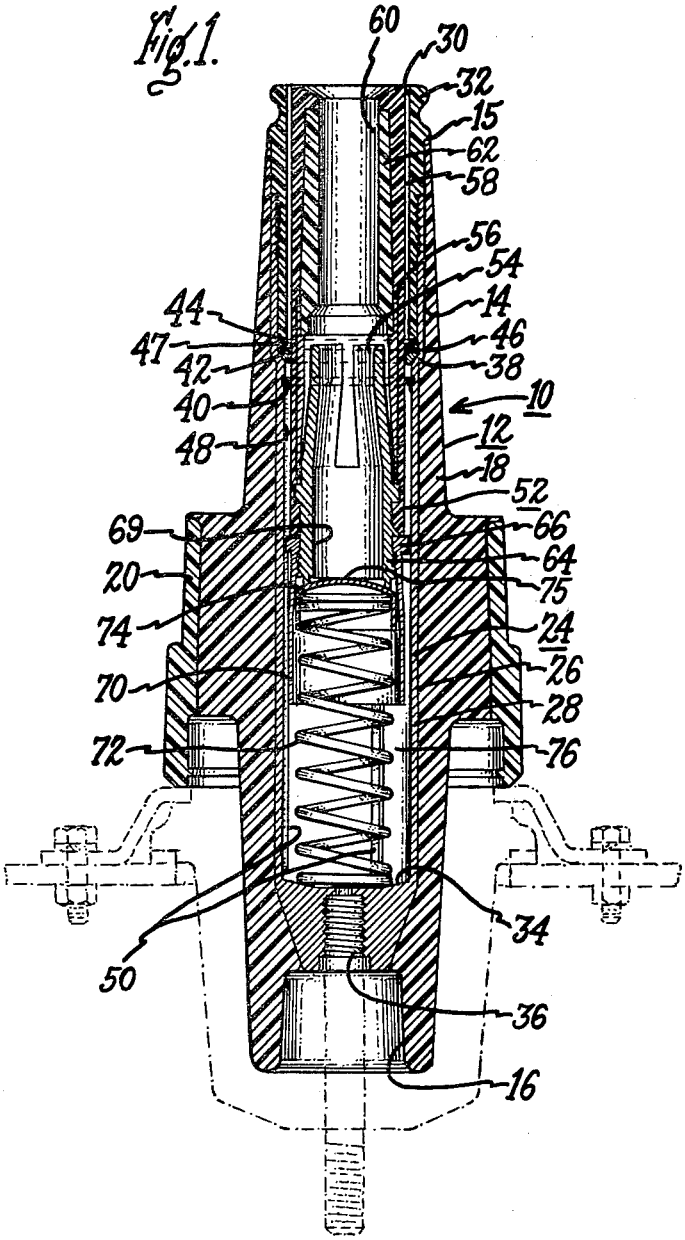
FIG. 1 is a front sectional view of a connector switch module in accordance with a first preferred embodiment of the present invention. It is installed in the well of a bushing shown in phantom lines.

A first preferred embodiment of the present invention is the electrical power cable separable connector module 10 shown in FIG. 1 of the drawings. The module 10 is a load switching bushing insert designed to be threaded into a bushing well, shown in phantom lines—such as would be found on a residential power transformer to permit connection of the bushing to a matching elbow module having a rod contact member and attached to a power cable.

The module 10 has an elongated housing 12 of EPDM (ethylene propylene diene monomer) elastomer. The housing 12 is provided with an elongated receiving passageway 14 extending from a receiving end 15 to an opposite terminal end 16. The bulk of the housing 12 is of elastomeric insulation 18. There is an external shield layer 20 of conductive elastomer about a portion of the outside perimeter of the housing 12 and a thin internal shield coating (not shown) of conductive elastomer paint on the inside surface of the passageway 14.

Figure 2:
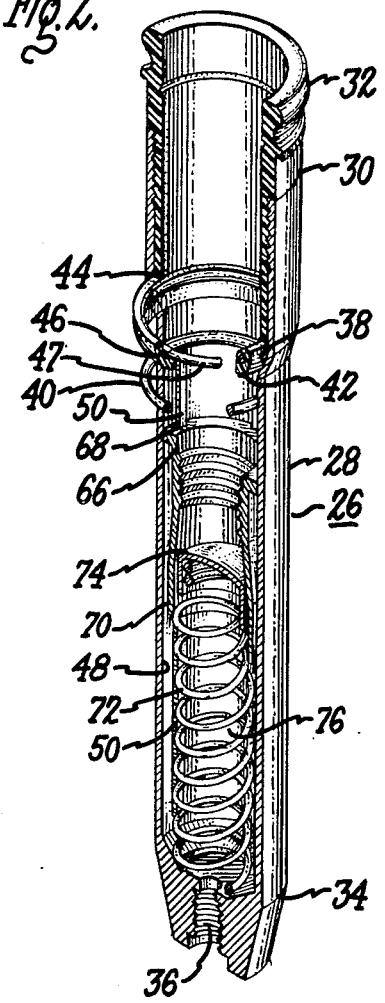
FIG. 2 is a partially sectioned projection view of a switch insert container of the module of FIG. 1.

Closely fitted into the passageway 14 is a switch insert 24. The insert 24 includes a container 26 shown in more detail in FIG. 2. The container 26 includes a container tube 28 fitted at its outer end 30 with a nosepiece 32 of glass-filled nylon and provided on the outside of its opposite inner end 34 with a threaded hole 36 for threading the module 10 on the threaded terminal stud in the bushing well. That outer end portion of the container tube 28 is expanded somewhat in diameter with a resulting shoulder 38, and provided with internal threads so that the nosepiece 32 can be threaded into it. The inside diameter of the nosepiece 32 is the same as the inside diameter of the major axial portion of the container tube 28. A shallow groove 40 is formed in the wall of the container tube 28 adjacent the shoulder 38 and an open steel retaining ring 42 seated in the groove 40.

Resting against the shoulder 38 is a nylon adaptor ring 42 which adapts the rounded configuration of the shoulder 38 to one with a square edge to match the edge 44 formed by the end of the nosepiece 32 and to thereby form an annular groove 46 in which is seated a resilient O-ring 47.

The interior wall 48 of the container tube 28 has three keyribs 50 formed in it, each having a substantially rectangular cross-section and running longitudinally from the inner end 34 of the container tube to just below the retaining ring 42. The keyribs 50 are equally spaced angularly about the axis of the container tube 28.

Figure 3:
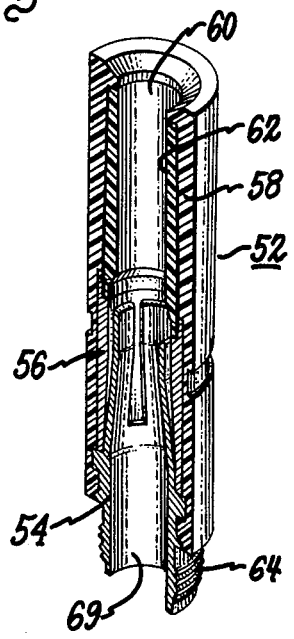
FIG. 3 is a sectioned projection view of a snuffer-contact assembly of the switch insert of FIG. 1 which is disposed in the container.

Disposed in the container 26 is a snuffer-contact assembly 52 which is shown separately in more detail in the FIG. 3 of the drawings. The snuffer-contact assembly 52 includes a copper bore contact 54 for engaging a male rod contact. Extending about the periphery of the contact 54 is a steel arc shield sleeve 56. The female contact 54 and arc sleeve 56 are surrounded by a molded insulating snuffer tube 58 of thermoplastic resin which has a central bore 60 lined with an ablative snuffer liner 62. The inner end of the contact 54 is provided with a threaded sleeve 64, on the outside of which is threaded an annular copper piston 66 which has three keyways 68 spatially matching the keyribs 50 of the container tube 28 so that they ride over the keyribs 50 and prevent rotation of the piston 66 in the container tube 28. A gas port 69 is provided by the central opening in the contact 54 and sleeve 64. Brazed to the piston 66 and extending away from the contact 54 toward the inner end 34 of the container 26 is a hardened copper sliding contact sleeve 70 which is fixed outwardly to resiliently engage the inner surfaces of the keyribs 50 and to thereby provide electrical contact between the contact 54 and the container 26.

An elongated compression spring 72 extends from the inner end 34 of the container tube 26 to the end of the threaded sleeve 64 of the contact 54 and is covered there by a domed metal valve cap 74 which seats against the end of the threaded sleeve 64 and provides a check valve 75 for trapping arc-generated gas in a gas retaining chamber 76 formed between the check valve 75 and the inner end of the container 28.

When the switch module 10 is operated under normal conditions and normal currents, the piston 66 of the insert remains passive and the snuffer-contact assembly 52 and piston 66 are held in position in the container 26 by the retaining ring 40. Arcing on loadbreak is quenched by the gases generated by the snuffer liner 62. Excessive gas depresses the valve cup 74 and passes through the gas port 69 into the chamber 76 to be released slowly when it is no longer highly ionized.

The piston 66 is designed to operate primarily in the event of a loadmake under fault current conditions. When the rod contact of the matching elbow connector is pushed into the bore 60 of the module 10 under fault current conditions, such as with a direct line-to-ground fault in the system, there comes a point when an arc will flash from the bore contact 54 to the rod over the intervening surface of the rod follower. This will instantly cause the generation of large amounts of gas. The gas will pass into the chamber 76 and drive the piston 66 forward toward the rod with considerable force, in the process breaking the snuffer-contact assembly 52 loose from the holding force of the retaining ring 40, to complete the contact of the bore contact 54 with the rod contact. The completion of the contact terminates the arcing and the further generation of gas. Protective devices such as a breaker or fuse in the circuit can then safely interrupt the current.

Figure 4:
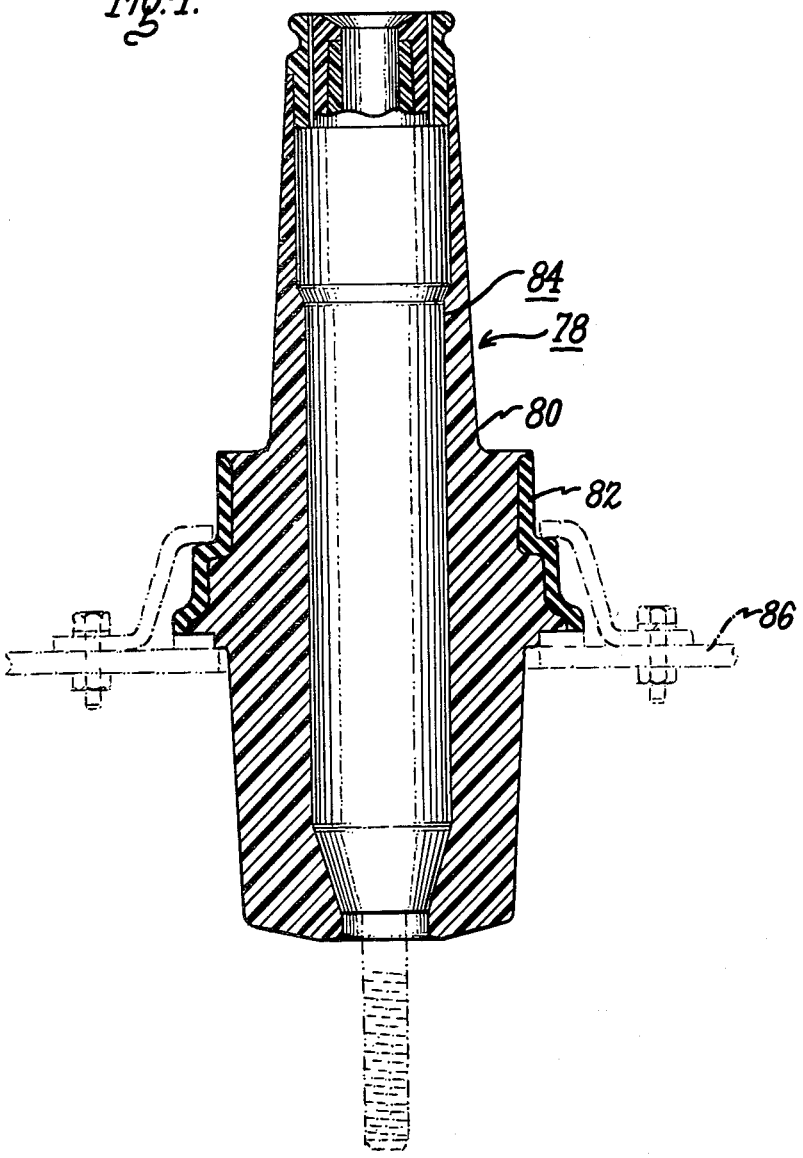
FIG. 4 is a partially cut away front view of a second embodiment of the present invention.

A second preferred embodiment of the present invention is the integrated bushing 78 shown in FIG. 4 of the drawings. The bushing 78 includes an insulation housing 80 of epoxy resin with an outer conductive shielding layer 82. The housing 80 is formed around a switch insert 84 which is substantially identical in structure and operation with the insert 24 of the module 10 described above. The reduced diameter of the insert 84 is particularly advantageous for this second embodiment in that it permits the insert 84 to extend through the plane of the wall 86 in which the bushing is to be mounted. Larger diameter inserts cannot extend through this plane without creating difficulties in meeting insulation requirements between the commonly used size of opening in the wall and the current carrying insert. These requirements evolved when the bushings were provided merely with a central conductor, without any internal switch features such as those of the insert 84, and therefore were not designed to accommodate a current carrying insert of much greater diameter. Most switching inserts associated with bushings have been incorporated in a separate module, such as the module 10 above, which was installed in a bushing well so that the insert extended outwardly from the wall. The resulting structure, however, is rather long and contributes to an already existing problem of insufficient space in certain residential transformer cabinets in which cables with mating elbows are trained. The integrated bushing 84, on the other hand, can have a lower profile which permits greater ease of operation of a mating elbow in such close quarters.

GENERAL CONSIDERATIONS

While the above preferred embodiments of the invention relate to bushings, it is understood that the invention may be incorporated in various other forms of separable connectors of the rod and bore type, such as for example multitaps and feed-throughs.

The outer configuration of the insert can be any configuration which does not have a section in which the diameter increases as one proceeds from the outer end to the inner end. However, the diameter may decrease gradually, in steps, or remain constant. This will still permit the piston to be installed from the receiving end of the housing into the receiving passageway after the manufacture of the housing. It is generally desirable to have at least a section of the container of constant diameter where the sliding contact of the snuffer-contact assembly slide as the piston travels.

The inner end of the insert container may not be actually closed, but may have a gas exhaust port or other opening. The outer end of the insert container and the bore may not be actually open at all times, but may have installed therein a gas trap valve for retaining gas in the bore of the snuffer-contact assembly on disconnection of the matching module to prevent a restrike.

The snuffer tube and liner need not necessarily be fixed to the contact and piston, but may be separately located in the container.

Other designs may be used for the sliding contact than those of the preferred embodiments, provided that the sliding contact member is fixed to the bore contact and resiliently presses against the inside surface of the container. A sleeve shaped sliding contact, such as the contact sleeve 70 of the preferred embodiment is particularly effective in exerting a high pressure at the contact areas and thereby minimizing the resistance.

The provision of keyribs in the wall of the container of the insert and of matching keyways in the piston, permit the snuffer and bore contacts to be threaded out of the piston and sliding contact and replaced with another set of snuffer and bore contacts. Thus the container with only the piston inside can be interchangeably fitted with snuffer and bore contact combinations other than that of the preferred embodiments.

We claim:

1. A separable electrical connector module for coupling with a mating connector module, comprising:

(a) an insulating housing having an elongated receiving passageway therein, and (b) a switch insert closely fitted in said passageway, said insert comprising:

(i) a rigid conductive container tube having an outer end for receiving a rod contact member of the mating connector module, an inner end, an axial portion of uniform diameter;

(ii) a snuffer tube in said container tube, said snuffer tube having a central bore for receiving said rod contact member and having inside said bore a layer of ablative material;

(iii) a bore contact member adjacent said inner end of said container tube, said contact member comprising a gas port;

(iv) a piston fixed to said bore contact member and adapted for driving said contact member along the axis of said container tube toward said outer end of said container tube in response to gas generated by arcing in said bore, said piston being keyed to said container tube to prevent it from rotation in said container tube; and (v) resiliently sliding contact member fixed to said piston and pressing outwardly against the inside wall of said container tube to establish continuous electrical contact with said inside wall while said piston is in motion:

(a) said inside wall including at least three axially extending keyribs, said keyribs being substantially equally spaced angularly about the axis of said container tube, each of said keyribs including an inner surface for electrically contacting said sliding contact member; and (b) said sliding contact member comprising a sleeve contact fixed at one end to said piston and flared outwardly to the other end for resiliently engaging said inner surfaces of said keyribs to provide said continuous electrical contact with said inside wall while said piston is in motion.

2. A separable electrical connector module in accordance with claim 1 in which the other end of said sleeve contact has a diameter which is greater than the diameter of a circle passing over said inner surfaces of said keyribs.

3. A separable electrical connector module in accordance with claim 1 in which said piston is removably fixed to said bore contact member and is prevented from rotating within said container tube by peripheral keyways which ride over said axially extending keyribs.

4. A separable electrical connector module in accordance with claim 3 in which said piston comprises an annular flange threadingly engaging said bore contact member.

5. A separable electrical connector module in accordance with claim 3 wherein said container tube comprises aluminum alloy and said sliding contact member comprises copper.

6. A separable electrical connector module in accordance with claim 5 in which said sliding contact member is plated over its contacting surface with tin.

7. A separable electrical connector module in accordance with claim 1 in which said container tube has a configuration such that its diameter does not increase from said outer end to said inner end.

8. A separable electrical connector in accordance with claim 1 in which said snuffer tube is provided with a first groove about its perimeter and directly opposite a second groove in said inside wall of said container tube wherein a radially resilient retaining ring is seated in said grooves for resiliently holding said snuffer tube in axial position inside said container tube.

9. A separable electrical connector module in accordance with claim 8 in which said retaining ring resiliently holds said snuffer tube in said axial position under normal conditions but permits axial motion of said snuffer tube toward said outer end of said container tube under fault conditions.

* * * * *